US009962303B1

(12) United States Patent
Wilson et al.

(10) Patent No.: US 9,962,303 B1
(45) Date of Patent: May 8, 2018

(54) COMBINATION WHEELCHAIR-WALKER DEVICE

(71) Applicant: YouWalk Today, Inc., Roseburg, OR (US)

(72) Inventors: Mike Wilson, Roseburg, OR (US); Stephen Sanford, Bozeman, MT (US); Ross Walker, Belgrade, MT (US); Oksana Davyda, Roseburg, OR (US)

(73) Assignee: YouWalk Today, Inc., Roseburg, OR (US)

( * ) Notice: Subject to any disclaimer, the term of this patent is extended or adjusted under 35 U.S.C. 154(b) by 0 days. days.

(21) Appl. No.: 15/657,179

(22) Filed: Jul. 23, 2017

(51) Int. Cl.

| | |
|---|---|
| ***A61H 3/04*** | (2006.01) |
| ***A61G 5/10*** | (2006.01) |
| ***A61G 5/08*** | (2006.01) |
| ***A61G 5/12*** | (2006.01) |
| ***A61G 5/02*** | (2006.01) |

(52) U.S. Cl.
CPC ..... *A61G 5/08* (2013.01); *A61G 5/022* (2013.01); *A61G 5/1018* (2013.01); *A61G 5/1035* (2013.01); *A61G 5/1051* (2016.11); *A61G 5/1054* (2016.11); *A61G 5/1089* (2016.11); *A61G 5/1091* (2016.11); *A61G 5/125* (2016.11); *A61G 5/128* (2016.11); *A61H 3/04* (2013.01); *A61H 2003/046* (2013.01)

(58) Field of Classification Search
CPC ..... A61H 3/04; A61G 5/1089
See application file for complete search history.

(56) References Cited

U.S. PATENT DOCUMENTS

| | | | | | |
|---|---|---|---|---|---|
| 865,514 | A | * | 9/1907 | Mullenmeister | B62B 1/002 280/10 |
| 1,739,260 | A | * | 12/1929 | Roe | A61G 5/06 280/11 |
| 2,427,161 | A | * | 9/1947 | Roe | A61G 5/1029 188/2 F |
| 2,694,437 | A | * | 11/1954 | Glaser | A61G 5/006 280/47.4 |
| 2,701,005 | A | * | 2/1955 | Bennett | A61G 5/06 16/18 B |
| 3,111,331 | A | * | 11/1963 | Locke | A61G 5/061 180/9.23 |
| 3,216,738 | A | * | 11/1965 | Bockus | A61G 5/10 188/DIG. 2 |
| 3,584,890 | A | | 6/1971 | Presty | |

(Continued)

FOREIGN PATENT DOCUMENTS

JP 2004202264 A * 7/2004

*Primary Examiner* — Joseph M Rocca
*Assistant Examiner* — Daniel S Yeagley
(74) *Attorney, Agent, or Firm* — Antoinette M. Tease

(57) ABSTRACT

A combination wheelchair-walker having an upper frame; a lower frame comprised of two arc-shaped members, in which each arch-shaped member is configured to extend from the front of the device to the back of the device, each of the two arc-shaped members having a front end and a rear end; two front wheels; two rear caster wheels, each of which is attached to the rear end of one of the two arc-shaped members; and two skids, each of which is attached to the front end of one of the two arc-shaped members. The upper frame is configured to be detached from the lower frame by unlocking four retention pins and lifting the upper frame off of the lower frame.

13 Claims, 10 Drawing Sheets

(56) References Cited

U.S. PATENT DOCUMENTS 3,719,390 A 3/1973 Haney
4,268,054 A * 5/1981 Twitchell ..... A61G 5/00 188/2 F
4,620,714 A * 11/1986 Davis ..... A61G 5/00 280/208
4,744,578 A * 5/1988 Stearns ..... A61G 5/00 280/250.1
4,759,562 A 7/1988 Vineyard
4,948,156 A 8/1990 Fortner
5,020,817 A * 6/1991 Leib ..... A61G 5/00 280/250.1
5,286,046 A * 2/1994 Bottemiller ..... A61G 5/00 188/2 F
5,320,122 A 6/1994 Jacobson
5,419,571 A 5/1995 Vaughan
5,451,193 A 9/1995 Pickard
5,702,326 A * 12/1997 Renteria ..... A61H 3/04 135/67
5,741,020 A 4/1998 Harroun
6,024,369 A * 2/2000 Goldstein ..... A61G 5/023 280/248
6,276,704 B1 * 8/2001 Suiter ..... A61G 5/00 180/907
6,338,493 B1 1/2002 Wohlgemuth
6,484,829 B1 * 11/2002 Cox ..... A61G 5/061 180/8.1
6,733,018 B2 * 5/2004 Razon ..... A61H 3/008 135/67
6,902,178 B2 * 6/2005 Wing ..... A61G 5/006 180/907
8,151,812 B2 * 4/2012 Razon ..... A61H 3/04 135/66
8,864,151 B1 * 10/2014 Liu ..... A61H 3/04 280/87.021
8,998,244 B2 4/2015 Purdue
9,398,988 B1 * 7/2016 DeMirza ..... A61G 5/025
2004/0135326 A1 * 7/2004 Palmers ..... A61H 3/04 280/5.2
2007/0012526 A1 * 1/2007 Holub ..... A61G 5/10 188/2 F
2011/0006494 A1 1/2011 Walker
2014/0300071 A1 10/2014 Purdue

* cited by examiner

COMBINATION WHEELCHAIR-WALKER DEVICE

BACKGROUND OF THE INVENTION

1. Field of the Invention

The present invention relates generally to the field of wheelchairs, and more particularly, to a wheelchair that can also be used as a walker.

2. Description of the Related Art

Current wheelchairs and walkers require the patient to switch between two pieces of equipment. As such, there is a need for a transitional medical device that would offer the functionality of both a wheelchair and a walker so that patients requiring the use of a wheelchair could work on developing or recovering their walking skills without leaving the wheelchair. A fear of falling often prevents individuals from attempting to use a walker. When individuals lose their mobility, they may become depressed as a result of their increased dependence on others. With a device that could be used both as a wheelchair and as a walker, more patients might be willing to attempt walking, which would improve their health and quality of life.

U.S. Pat. No. 3,584,890 (Presty, 1971) discloses a wheelchair with removable armrests that can be attached to the wheelchair frame in such a manner that the armrests act as extensible and removable supports that are engageable with the floor. In one embodiment, the supports include ground-engaging wheels, which allow the device to be used as a walker.

U.S. Pat. No. 3,719,390 (Haney, 1973) provides a wheelchair with a pivoting seat and an auxiliary frame that is coupled telescopically to the wheelchair main frame to allow the user to stand in an erect position. The auxiliary frame has a pair of vertically oriented legs that engage with the floor and that are connected by a lifting-bar. The purpose of the lifting-bar is to allow the operator to position the seat of the wheelchair relative to a toilet and hoist himself (with the use of the lifting-bar) into a standing position to gain access to the toilet.

U.S. Pat. No. 4,759,562 (Vinyard et al., 1988) discloses a kit for converting a wheelchair into a walker. The kit includes a seat for replacing the wheelchair bottom, a base for mounting the seat to the wheelchair, and an inverted U-shaped support bar. The support bar retains the patient between the sides of the wheelchair and seat.

U.S. Pat. No. 4,948,156 (Fortner, 1990) provides a frame that can be attached to a wheelchair to enable the user to move from a seated position in a wheelchair to a standing position without assistance from another person. The device incorporates a manually operated worm gear mechanism to facilitate lifting and prevent reverse movement of the lifting means when under load.

U.S. Pat. No. 5,320,122 (Jacobson, II et al., 1994) discloses a combined walker and wheelchair in which the seat assembly is slidably attached to the frame between a raised position and a lowered position. A spring causes the seat assembly to return to a raised position when weight is removed from the seat, and the seat pivotally returns to a lowered position when force (or weight) is applied to the seat. The frame assembly includes wheels that allow it to be moved along a floor surface. The chair is not self-propelled when the user is in the sitting position.

U.S. Pat. No. 5,419,571 (Vaughan, 1995) provides a collapsible wheelchair with a telescopically extending walker. In order to utilize the walker, the patient must push forward on the handrails and/or footrests to move each side of the walker forward until they are secured in an extended position. The patient would need assistance in order to convert the walker back into a wheelchair. The chair seat is configured so that it can be flipped up when not in use.

U.S. Pat. No. 5,451,193 (Pickard, 1995) discloses a combined wheelchair and walker with a braking device that is operatively associated with the seat. In a preferred embodiment, the brakes are not engaged with the wheels when the seat is in a raised position (walker mode). In an alternate embodiment, the brake is manually activated by the user whether the device is in wheelchair mode or walker mode.

U.S. Pat. No. 5,741,020 (Harroun, 1998) provides a collapsible combination chair-walker. The device includes a front rail and detachable safety strap. The chair has caster wheels but is not self-propelling (that is, it does not incorporate the larger rear wheels typically seen on a self-propelled wheelchair). The front rail is movable between a closed and locked position for normal operation and an open position for permitting ingress to and egress from the chair.

U.S. Pat. No. 6,338,493 (Wohlgemuth el al., 2002) discloses an apparatus that is convertible between a walker and a wheelchair. The rear pair of wheels is continuously engaged with the ground, and the front pair of wheels can be rotated upward (together with the footrests) to use the device as a walker. The seat also pivots upward when the device is in walker mode. The user cannot, however, simply stand up from the wheelchair seat into the walker; instead, the user would need to stand up without handrail assistance, turn around, and face in the other direction in order to use the walker. The user of this device could not simply sit down if he or she tired of walking.

U.S. Pat. No. 8,998,244 (Purdue, 2015) provides a wheelchair with a detachable walker. The walker is mechanically attached to the wheelchair by securing downwardly directed members into attachment sockets; according to the inventor, this procedure is performed by the caregiver (col. 2, lines 26-28). Presumably, a caregiver would be required to detach the walker from the wheelchair as well.

U.S. Patent Application Pub. No. 20110006494 (Walker) discloses a wheelchair with an extendable walker. The walker portion of the apparatus extends telescopically forward from the main wheelchair frame. As with Vaughan (referenced above), the user could not easily retract the walker back into the wheelchair without assistance. Furthermore, this device requires a mechanical conversion between wheelchair and walker modes, which the present invention does not.

It is an object of the present invention to provide a wheelchair that can also be used for walking with or without assistance. It is another object of the present invention to provide a wheelchair that is either self-propelled or that can be propelled by an aide. It is yet another object of the present invention to provide a wheelchair with safety features such as hand brakes, skids and safety straps to prevent falling and to alleviate the fear of falling. It is yet another object of the present invention to provide a wheelchair that can be disassembled for transport. Finally, it is an object of the present invention to provide a wheelchair that can be used as a walker without requiring the patient to stand up and physically convert the wheelchair into a walker.

BRIEF SUMMARY OF THE INVENTION

The present invention is a combination wheelchair-walker device with a front and a back comprising: an upper frame;

a lower frame comprised of two arc-shaped members, wherein each arch-shaped member is configured to extend from the front of the device to the back of the device, each of the two arc-shaped members having a front end and a rear end; two front wheels; two rear caster wheels, each of which is attached to the rear end of one of the two arc-shaped members; and two skids, each of which is attached to the front end of one of the two arc-shaped members. The invention preferably further comprises a seat frame, a seat pad, and a back pad.

In a preferred embodiment, the invention further comprises two footrests, each of which is attached to a footrest frame mount; wherein the footrest frame mount is comprised of a horizontal part and a vertical part joined together at a ninety-degree angle; and wherein the vertical part is attached to a wheel mount that is fixedly attached to one of the two front wheels. The invention preferably further comprises two push rails, each of which is spaced apart from and outwardly of one of the two front wheels; wherein each of the two front wheels comprises a front wheel frame; and wherein the push rail is connected to the front wheel frame of one of the two front wheels.

In a preferred embodiment, the invention further comprises a front push bar that is U-shaped; wherein each end of the U-shaped push bar terminates in a tube member; wherein each of the tube members fits telescopically into a front handlebar; and wherein the front handlebars extend forwardly from the upper frame. Preferably, the invention further comprises a fall restraint assembly; wherein the fall restraint assembly comprises a safety strap, two loop members that encircle the front push bar, a clasp and a buckle; wherein the safety strap is Y-shaped and extends from the two loop members to a central point where the safety strap continues as a single strap to the clasp; and wherein the buckle is located on an underside of the seat frame, and the claps fits into the buckle.

In a preferred embodiment, the upper frame is comprised of two rear vertical members that terminate in backwardly extending rear handlebars, two front support members with lower ends that constitute upper vertical telescoping tubes, two lower connection members to which the seat pad is attached, and two upper connecting members that connect the front support members to the rear vertical members; and wherein each of the front support members is comprised of an upper vertical telescoping tube portion, a front handlebar, and a straight central portion that joins the vertical telescoping tube portion and the front handlebar. Preferably, the invention further comprises two armrests that are situated on top of the upper connecting members. The invention preferably further comprises a rear push bar that is removably attached to a rear end of each of the two upper connecting members.

In a preferred embodiment, the invention further comprising two footrests, each of which is attached to a footrest frame mounts; wherein the footrest frame mount is comprised of a horizontal part and a vertical part joined together at a ninety-degree angle; wherein the vertical part of the footrest frame mount is attached to a wheel mount that is fixedly attached to one of the two front wheels; wherein the upper vertical telescoping tubes are configured to fit into the vertical part of the footrest frame mount; wherein the vertical part of the footrest frame mount is configured to form a receptacle for receiving the upper vertical telescoping tube; and wherein a lower vertical telescoping tube extends upwardly from a rear end of each of the two arc-shaped members and is configured to fit into a receptacle formed by a lower end of one of the two rear vertical members. Preferably, the invention further comprises a joinder bar that connects the two arc-shaped members; wherein each end of the joinder bar terminates in a vertical tube that is secured adjacent to the vertical part of the footrest frame mount.

In a preferred embodiment, the invention further comprises a brake assembly; wherein the brake assembly comprises a hand brake, a brake pad housing, a brake pad, and a brake cable. In another preferred embodiment, the upper frame is configured to be detached from the lower frame by unlocking four retention pins and lifting the upper frame off of the lower frame, two of the four retention pins being used to secure the upper vertical telescoping tubes into the vertical part of the footrest frame mounts, and the remaining two of the four retention pins being used to secure the lower vertical telescoping tubes into the receptacles formed by the lower ends of the rear vertical members.

REFERENCE NUMBERS

Figure 1:
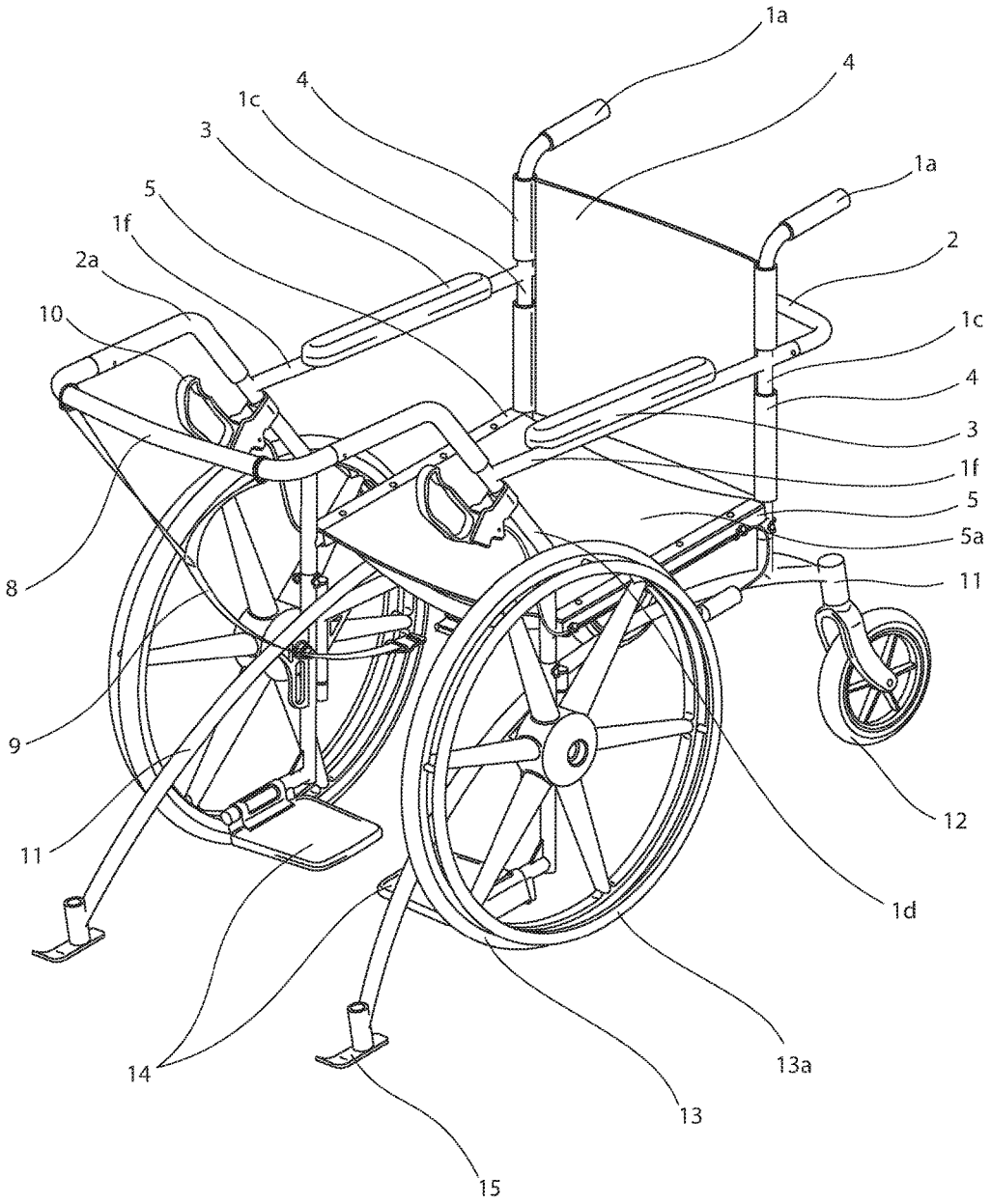
FIG. 1 is a perspective view of the present invention shown with the footrests in a down position.

1 Upper frame
1*a* Rear handlebar
1*b* Upper vertical telescoping tube
1*c* Rear vertical member
1*d* Front support member
1*e* Lower connecting member
1*f* Upper connecting member
2 Rear push bar
2*a* Front handlebar
3 Armrest
4 Seat back pad
5 Seat frame
5*a* Seat pad
6 Spring button
7 Retention pin
7*a* Vertical retention pin
8 Front push bar
8*a* Telescoping member (long)
8*b* Telescoping member (short)

9 Fall restraint safety strap
9*a* Loop member
9*b* Clasp
9*c* Buckle
10 Hand brake
10*a* Brake pad housing
10*b* Brake pad
10*c* Brake cable
11 Lower frame
11*a* Lower vertical telescoping tube
11*b* Wheel mount
11*c* Footrest frame mount
11*d* Joinder bar
11*e* Vertical tube
11*f* Bracket
12 Rear caster wheel
13 Front wheel
13*a* Front wheel push rail
13*b* Front wheel bolt
14 Footrest
15 Skid

DETAILED DESCRIPTION OF INVENTION

FIG. 1 is a perspective view of the present invention shown with the footrests in a down position. As shown in this figure, the invention is comprised of an upper frame 1, a lower frame 11, two front wheels 13, and two caster wheels 12. The invention is further comprised of a seat frame 5, seat pad 5*a*, and back pad 4. In FIG. 1, the footrests 14 are shown in a down position. The lower frame 11 is comprised of two arc-shaped members (see also FIG. 4), each of which is oriented so that the arcs extend from front to back. The rear end of each arc-shaped member is attached to a caster wheel 12. The front end of each arc-shaped member is attached to a skid 15.

Figure 2:
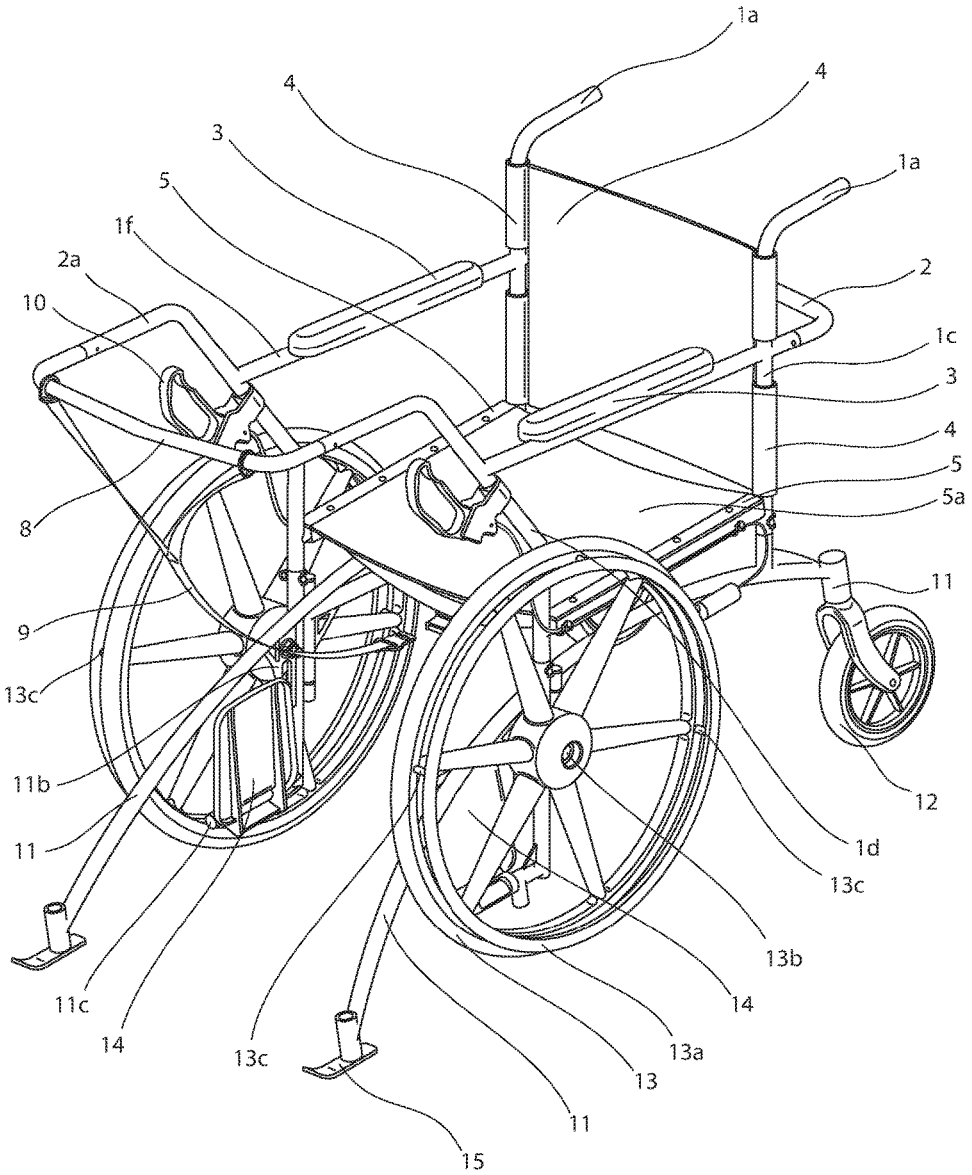
FIG. 2 is a perspective view of the present invention shown with the footrests in an up position.

FIG. 2 is a perspective view of the present invention shown with the footrests in an up position. Each footrest 14 is attached to a footrest frame mount 11*c*, which is comprised of a horizontal part and a vertical part joined together at a ninety-degree angle (see FIG. 4). The vertical part is attached to a wheel mount 11*b*, which is fixedly attached to the wheel 13 with a bolt 13*b*. Each of the front wheels comprises a push rail 13*a*, which is spaced apart from and outwardly of the front wheel 13 and is connected to the front wheel frame via a plurality of connectors 13*c*. The push rail 13*a* allows the user to propel the wheelchair manually while seated in it and without assistance from another person.

Figure 3:
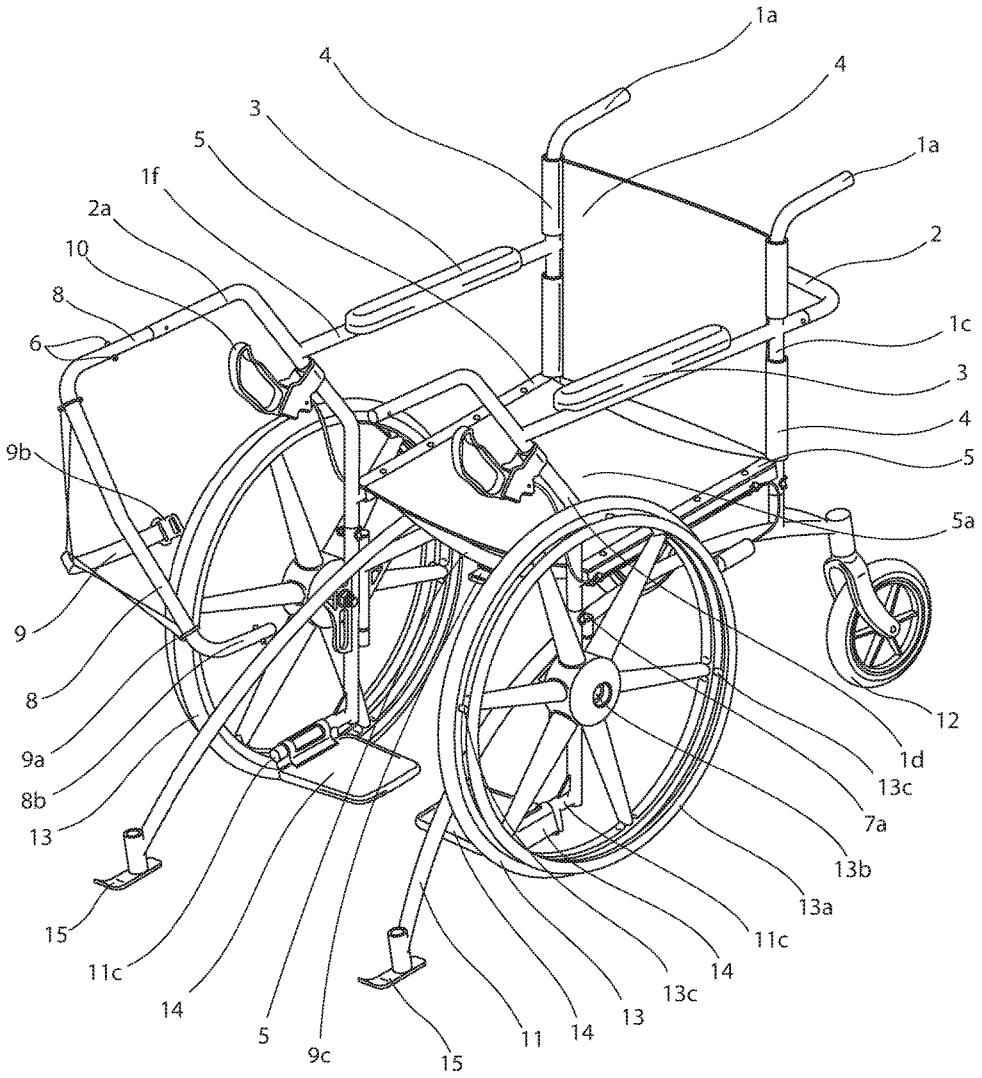
FIG. 3 is a perspective view of the present invention shown with the front push bar open and the fall restraint assembly detached from the seat frame.

FIG. 3 is a perspective view of the present invention shown with the front push bar open and the fall restraint assembly detached from the seat frame. This is the position in which the chair would need to be in order for someone to get into it (sit down). As shown in this figure, the front push bar 8 is U-shaped (see also FIG. 4) with each end of the U terminating in a tube member. The tube members 8*a*, 8*b* fit telescopically into the front handlebars 2*a*, which extend forwardly from the upper frame 1 (see also FIG. 4). Note that 8*a* is preferably longer than 8*b* to allow the front push bar 8 to swing down and hang within the front handlebar 2*a* without having to be completely removed when the user enters or exits the chair (as shown in FIG. 3). The fall restraint assembly comprises a safety strap 9, two loop members 9*a* that encircle the front push bar 8 at its left and right ends, a clasp 9*b* and a buckle 9*c*. In a preferred embodiment, the safety strap 9 is Y-shaped and extends downward from the two loop members 9*a* to a central point, where the safety strap continues as a single strap (the bottom of the "Y") to the clasp 9*b* (see also FIG. 6). The clasp 9*b* fits into a buckle 9*c* on the underside of the seat frame 5.

Figure 4:
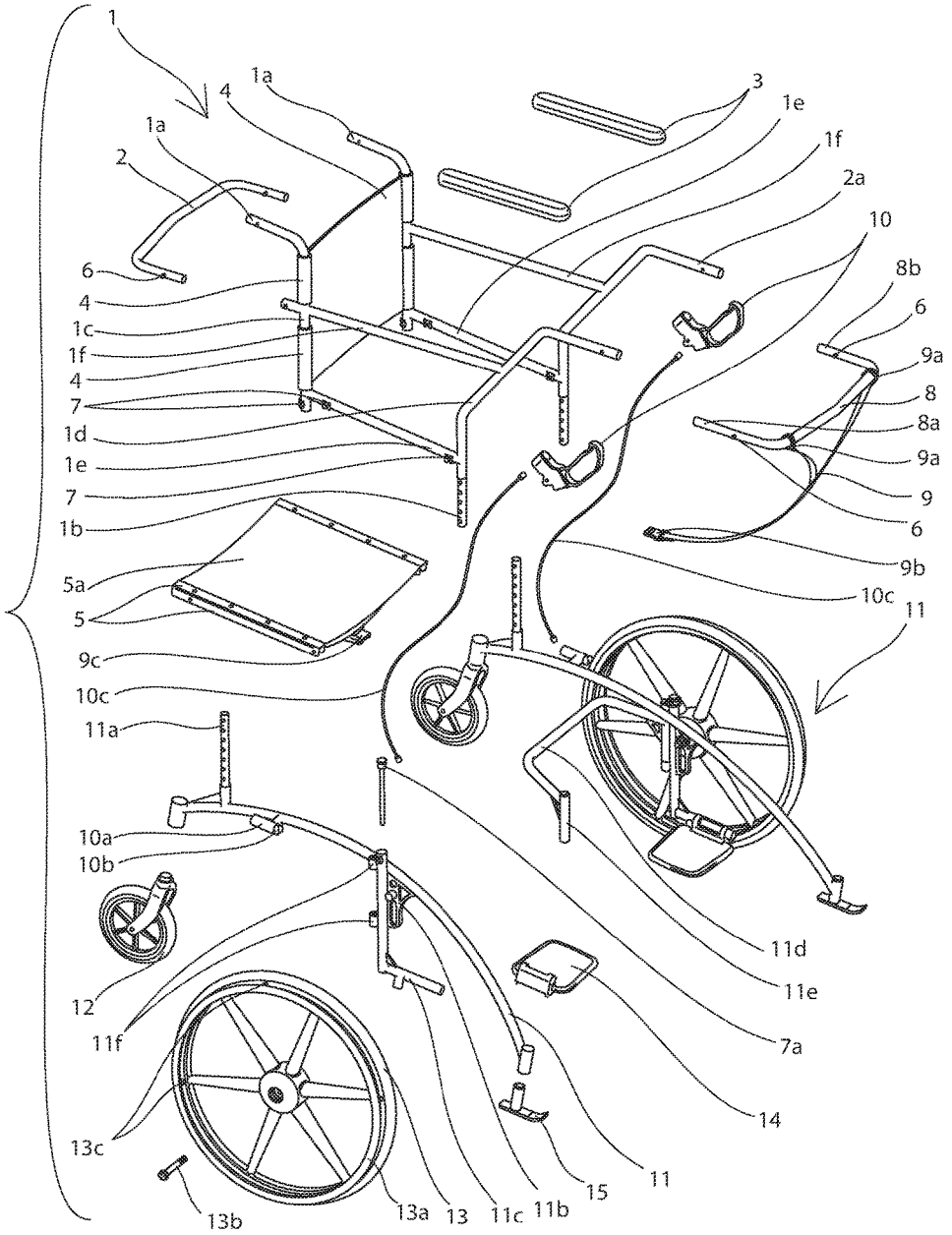
FIG. 4 is an exploded view of the present invention.

FIG. 4 is an exploded view of the present invention. As shown in this figure, the upper frame 1 is comprised of two rear vertical members 1*c* that terminate in backwardly extending rear handlebars 1*a*, two front support members 1*d* whose lower ends constitute upper vertical telescoping tubes 1*b*, two lower connecting members 1*e* to which the seat pad 5*a* is attached with retention pins 7, and two upper connecting members 1*f* that connect the front support members 1*d* to the rear vertical members 1*c*. Each of the front support members 1*d* is comprised of an upper vertical telescoping tube portion 1*b*, a front handlebar 2*a*, and a straight central portion that joins the vertical telescoping tube portion and the front handlebar. In this example, the angle between the vertical telescoping tube portion and the central portion is approximately one hundred thirty-five degrees, as is the angle between the front handlebar and the central portion.

When the chair is assembled, armrests 3 are situated on top of the upper connecting members 1*f*. A rear push bar 2 is removably attached to the rear end of the two upper connecting members 1*f*, as shown. A spring button 6 allows a person to remove the rear push bar 2 by depressing the spring button. Similarly, a spring button 6 allows the front push bar 8 to be detached from the front handlebars 2*a*. The front and rear handlebars 2*a*, 1*a* and the front and rear push bars 8, 2 are all preferably covered with a foam grip. The foam grips are shown in FIG. 1 but removed from subsequent figure for clarity.

As shown in this figure, when the chair is assembled, the upper vertical telescoping tubes 1*b* fit into the vertical part of the footrest frame mount 11*c*, which forms a receptacle for receiving the upper vertical telescoping tube 1*b*. Similarly, the lower vertical telescoping tubes 11.*a* extending from the rear of the lower frame 11 fit into receptacles formed by the lower ends of the rear vertical members 1*c* (see also FIG. 8). A joinder bar 11*d* connects the two arc-shaped members of the lower frame 11. Each end of the joinder bar 11*d* terminates in a vertical tube 11*e* that is held by brackets 11*f* adjacent to the vertical part of the footrest frame mount 11*c* and secured with a vertical retention pin 7*a*. The joinder bar 11*d* provides added stability to the lower frame 11.

Figure 5A:
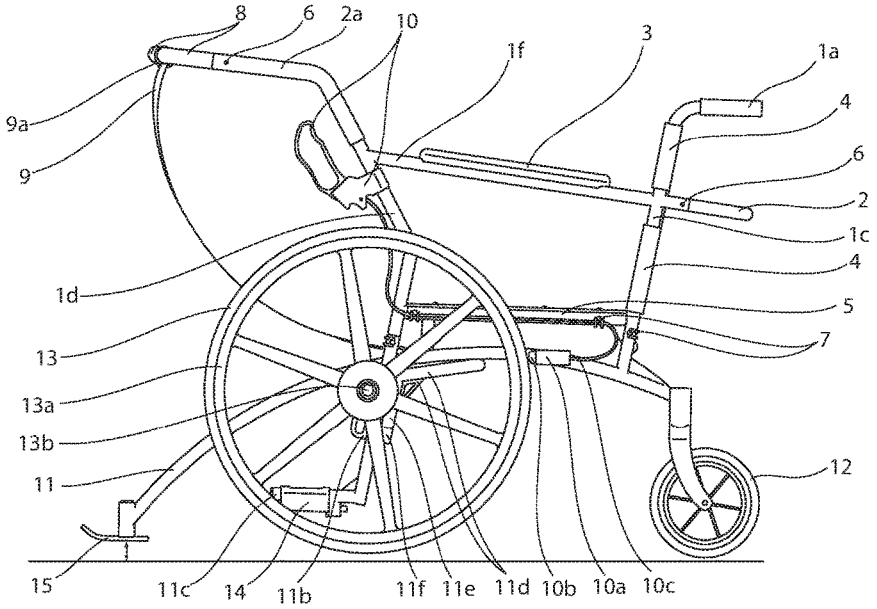
FIG. 5A is a side view of the present invention shown with the wheelchair tipped backward so that the caster wheels are on the ground and the skids are up.
Figure 5B:
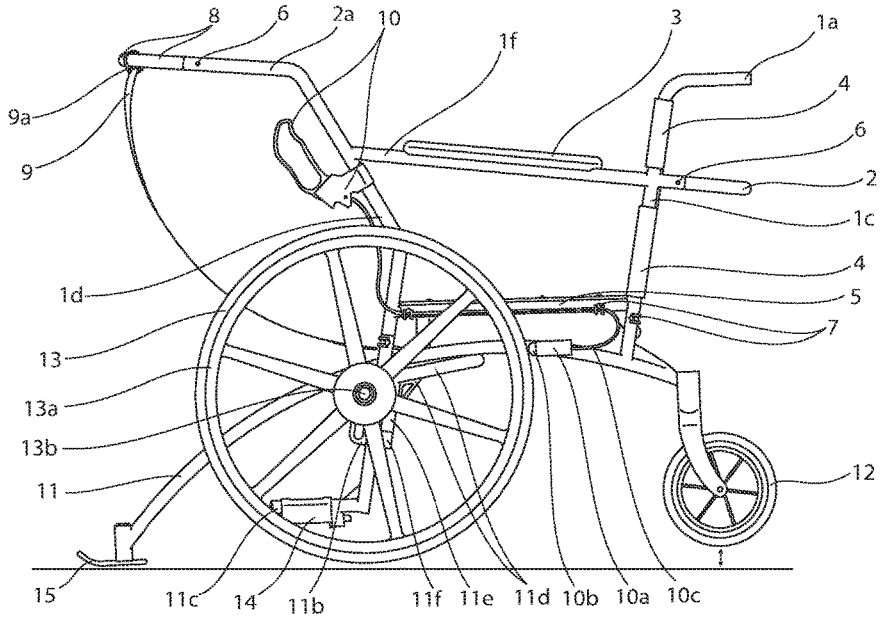
FIG. 5B is a side view of the present invention shown with the wheelchair tipped forward so that the skids are on the ground and the caster wheels are up.

FIG. 5A is a side view of the present invention shown with the wheelchair tipped backward so that the caster wheels are on the ground and the skids are up. FIG. 5B is a side view of the present invention shown with the wheelchair tipped forward so that the skids are on the ground and the caster wheels are up. As shown in these two figures, the central axis of the front wheels 13 acts as a fulcrum about which the entire wheelchair rotates or tilts, depending on how the user places his or her weight. For example, when the user is sitting in the wheelchair, the caster wheels 12 will be in contact with the ground, as shown in FIG. 5A. When the user stands up and places his or her weight on the front push bar 8, then the wheelchair is in the position shown in FIG. 5B, with the skids 15 on the ground. To use the device as a walker, the user would lift up on the front push bar 8 so that the skids 15 are no longer in contact with the ground, take a step, and then place the skids 15 back down on the ground to prevent the wheelchair from moving.

The length and arc of the lower frame 11 are configured so that when someone is sitting in the chair or when no one is sitting in the chair nor placing weight on the front push bar 8, all four wheels (the two front wheels 13 and the two rear caster wheels 12) are in contact with the ground, and the skids 15 are above the ground. As soon as weight is placed onto the front push bar 8, the chair tilts forward (around the central axis of the front wheels) so that the rear caster wheels 12 are above the ground and the skids 15 are in contact with the ground.

Figure 6:
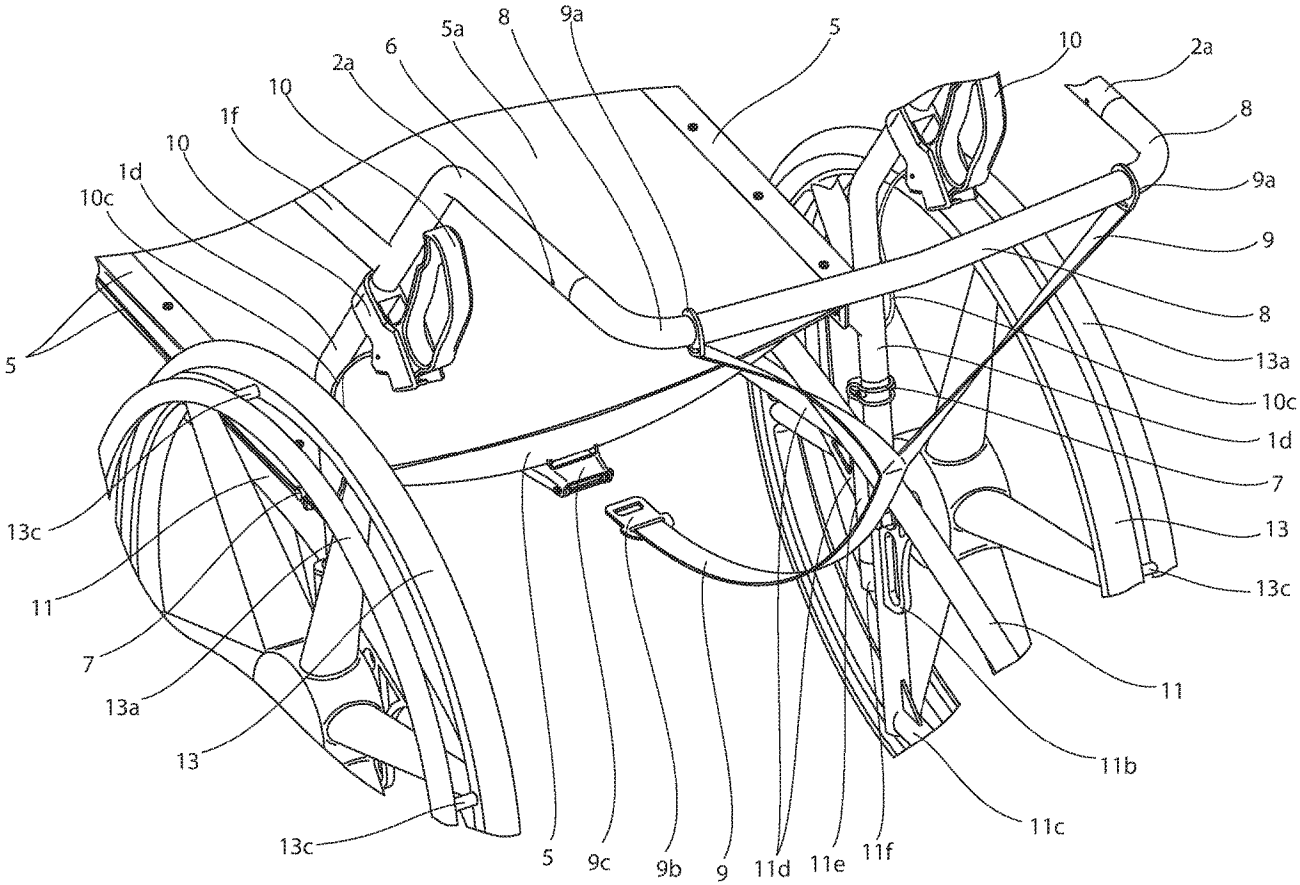
FIG. 6 is a detail perspective view of the fall restraint assembly.

FIG. 6 is a detail perspective view of the fall restraint assembly. As described above, the fall restraint assembly is comprised of a safety strap 9, two loop members 9*a* that encircle the front push bar 8 at its left and right ends, a clasp 9*b* and a buckle 9*c*. This figure clearly shows the loop members 9*a* and the Y-shaped safety strap 9, as well as the buckle 9*c* on the underside of the seat frame 5. When the device is used as a walker, the bottom part of the Y-shaped safety strap will be positioned between the user's two legs so that if he falters, he would not fall to the ground. At the same time, the two strap segments that form the top part of the Y-shaped safety strap will cradle the user's upper body.

Figure 7A:
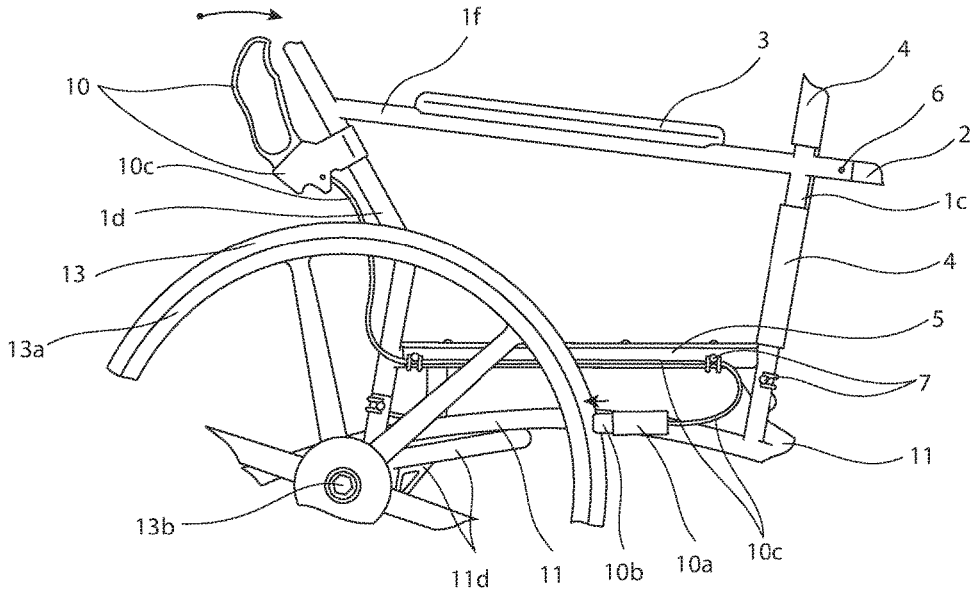
FIG. 7A is a partial side view of the present invention showing the brake assembly in a braking position.
Figure 7B:
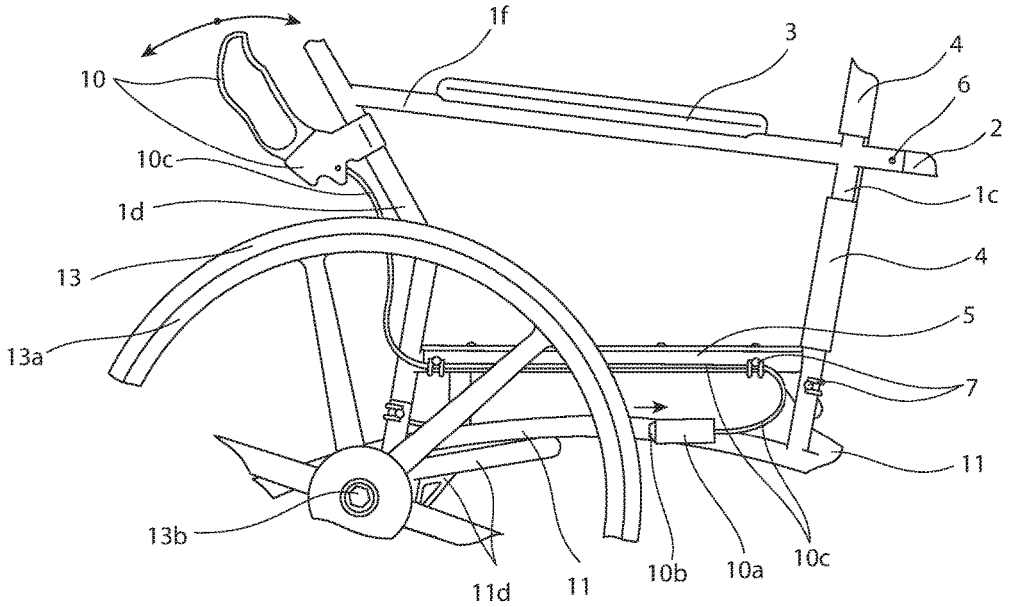
FIG. 7B is a partial side view of the present invention showing the brake assembly in a neutral position.
Figure 7C:
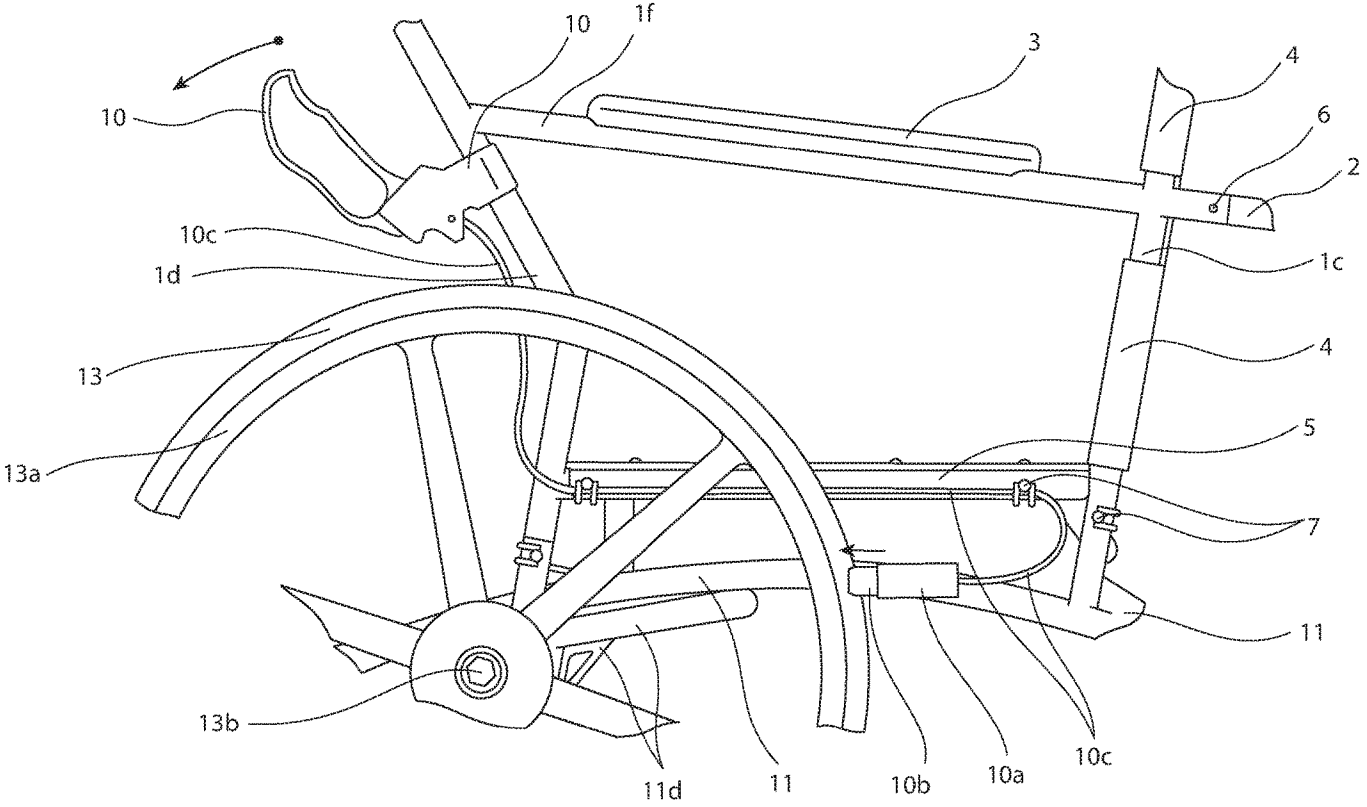
FIG. 7C is a partial side view of the present invention showing the brake assembly in a parking position.

FIGS. 7A, 7B and 7C show the brake assembly of the present invention in a braking, neutral and parking position, respectively. The brake assembly comprises a hand brake 10, brake pad housing 10*a*, brake pad 10*b*, and brake cable 10*e*. To use the brake while in the chair, the user would squeeze on the hand brake 10, pulling it toward the front support member 1*d*. This action would cause the brake pad 10*b* to engage with the front wheel 13, as shown in FIG. 7A. The brake assembly will only remain in a braking position as long as the user is squeezing the hand brake 10; once pressure on the hand brake is released, the brake system will automatically return to the neutral position, disengaging the brake pad 10*b* from the front wheel 13 (FIG. 7B).

To put the brake assembly into a parking position, from the neutral position the user would push the hand brake 10 forward (away from the front support member 1*d*) until the hand brake audibly clicks, at which point the brake pad 10*b* would engage with the front wheel 13 (as shown in FIG. 7C) and remain in that position until the hand brake 10 is once again moved rearward. Note that the brake pad 10*b* is housed within the brake pad housing 10*a*, and the brake pad 10*b* is connected to the hand brake 10 via the brake cable 10*c*.

Figure 8:
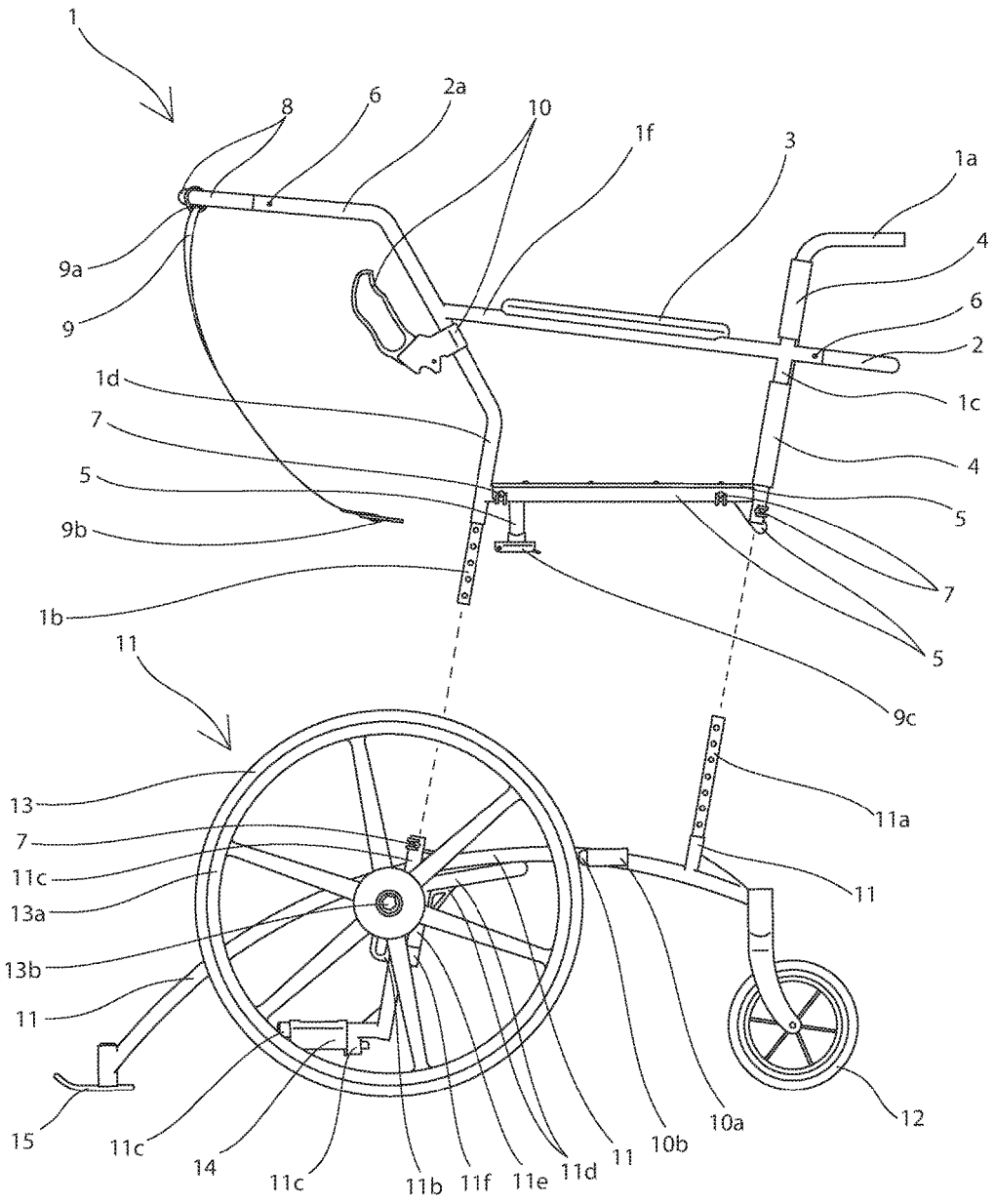
FIG. 8 is a side view of the present invention shown with the upper frame detached from the lower frame.

FIG. 8 is a side view of the present invention shown with the upper frame detached from the lower frame. In this particular embodiment, the buckle 9*c* is attached to the seat frame 5 via a downwardly protruding extension of the seat frame 5, as shown. This is to facilitate access to the buckle 9*c*. This figure clearly shows how the upper vertical telescoping tubes 1*b* fit into the vertical part of the footrest frame mount 11*c* and the lower vertical telescoping tubes 11*a* fit into receptacles formed by the lower ends of the rear vertical members 1*c*. Both the upper vertical telescoping tubes and the lower vertical telescoping tubes are secured in place with retention pins 7. The fact that the upper frame 1 can be detached from the lower frame 11 by simply unlocking four retention pins and lifting the upper frame off of the lower frame is a distinct advantage of the present invention.

Figure 9:
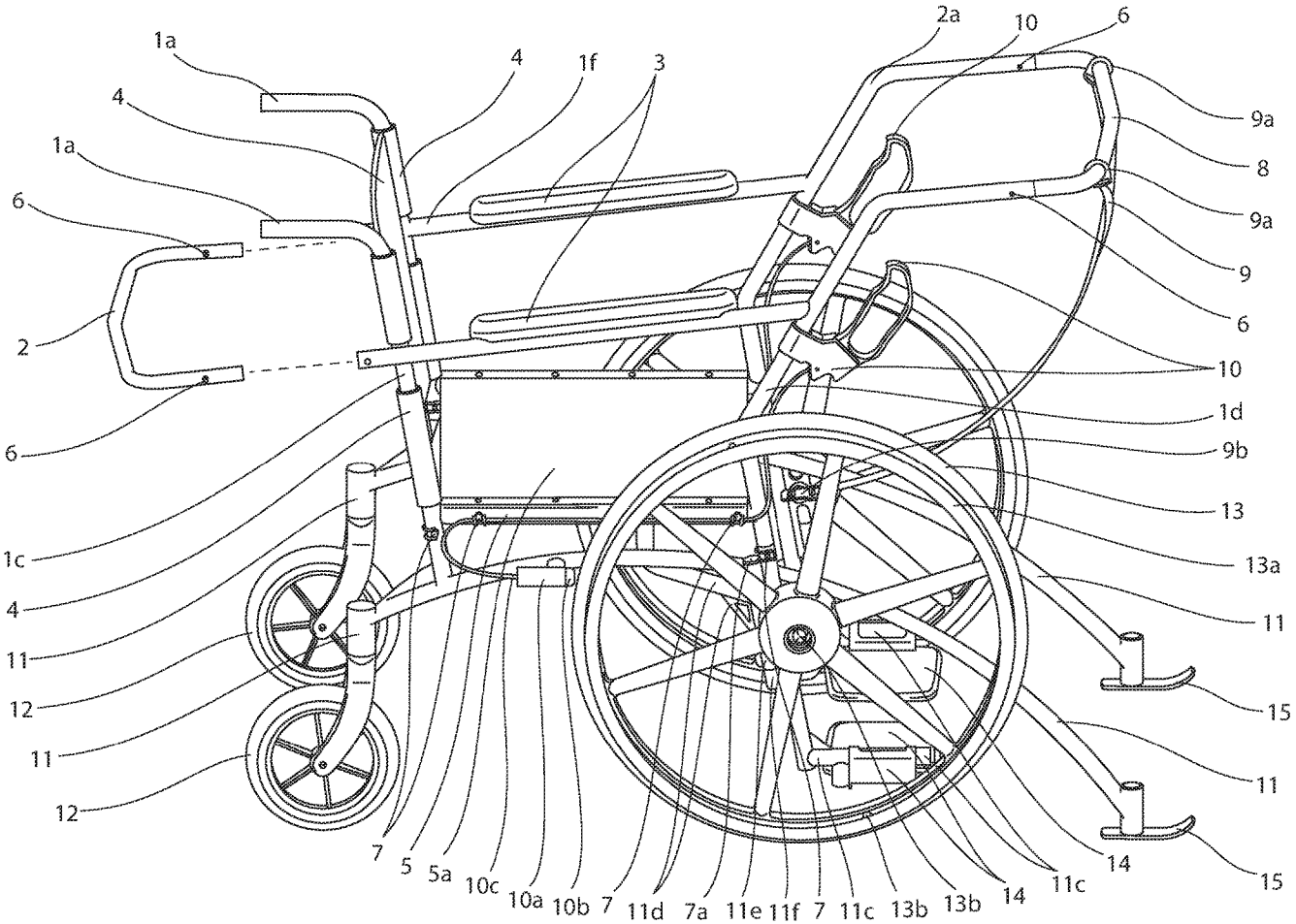
FIG. 9 is a top perspective view of the present invention shown with the rear push bar detached from the upper frame.

FIG. 9 is a top perspective view of the present invention shown with the rear push bar detached from the upper frame. As mentioned above, the rear push bar 2 is removably attached to the rear end of the two upper connecting members 1*f*. Having the rear push bar 2 in addition to the rear handlebars 1*a* makes it easier for a person to push the wheelchair from behind.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A combination wheelchair-walker device with a front and a back comprising:

(a) an upper frame;

(b) a lower frame comprised of two upwardly curved arc-shaped members, wherein each arc-shaped member is configured to extend from the front of the device to the back of the device, each of the two arc-shaped members having a front end and a rear end;

(c) two front wheels, wherein at least one of the two front wheels are directly attached to at least one footrest frame mount;

(d) two rear caster wheels, each of which is attached to the rear end of one of the two arc-shaped members; and (e) two skids, each of which is attached to the front end of one of the two arc-shaped members.

2. The combination wheelchair-walker device of claim 1, further wherein the at least one footrest frame mount comprises two footrest frame mounts, wherein a footrest is attached to each of the footrest frame mounts; and wherein each footrest frame mount is comprised of a horizontal part and a vertical part joined together at a ninety-degree angle; and wherein the vertical part is attached to a wheel mount that is fixedly attached to one of the two front wheels.

3. The combination wheelchair-walker device of claim 2, further comprising a joinder bar that connects the two arc-shaped members;

wherein each end of the joinder bar terminates in a vertical tube that is secured adjacent to the vertical part of the footrest frame mount.

4. The combination wheelchair-walker device of claim 1, further comprising a seat frame, a seat pad, and a back pad.

5. The combination wheelchair-walker device of claim 4, further comprising a front push bar that is U-shaped;

wherein each end of the U-shaped push bar terminates in a tube member;

wherein each of the tube members fits telescopically into a front handlebar; and wherein the front handlebars extend forwardly from the upper frame.

6. The combination wheelchair-walker device of claim 5, further comprising a fall restraint assembly;

wherein the fall restraint assembly comprises a safety strap, two loop members that encircle the front push bar, a clasp and a buckle;

wherein the safety strap is Y-shaped and extends from the two loop members to a central point where the safety strap continues as a single strap to the clasp; and wherein the buckle is located on an underside of the seat frame, and the claps fits into the buckle.

7. The combination wheelchair-walker device of claim 4, wherein the upper frame is comprised of two rear vertical members that terminate in backwardly extending rear handlebars, two front support members with lower ends that constitute upper vertical telescoping tubes, two lower connection members to which the seat pad is attached, and two upper connecting members that connect the front support members to the rear vertical members; and wherein each of the front support members is comprised of an upper vertical telescoping tube portion, a front handlebar, and a straight central portion that joins the vertical telescoping tube portion and the front handlebar.

8. The combination wheelchair-walker device of claim 7, further comprising two armrests that are situated on top of the upper connecting members.

9. The combination wheelchair-walker device of claim 7, further comprising a rear push bar that is removably attached to a rear end of each of the two upper connecting members.

10. The combination wheelchair-walker device of claim 7, further comprising two footrests, each of which is attached to a footrest frame mounts;

wherein the footrest frame mount is comprised of a horizontal part and a vertical part joined together at a ninety-degree angle;

wherein the vertical part of the footrest frame mount is attached to a wheel mount that is fixedly attached to one of the two front wheels;

wherein the upper vertical telescoping tubes are configured to fit into the vertical part of the footrest frame mount;

wherein the vertical part of the footrest frame mount is configured to form a receptacle for receiving the upper vertical telescoping tube; and wherein a lower vertical telescoping tube extends upwardly from a rear end of each of the two arc-shaped members and is configured to fit into a receptacle formed by a lower end of one of the two rear vertical members.

11. The combination wheelchair-walker device of claim 10, wherein the upper frame is configured to be detached from the lower frame by unlocking four retention pins and lifting the upper frame off of the lower frame, two of the four retention pins being used to secure the upper vertical telescoping tubes into the vertical part of the footrest frame mounts, and the remaining two of the four retention pins being used to secure the lower vertical telescoping tubes into the receptacles formed by the lower ends of the rear vertical members.

12. The combination wheelchair-walker device of claim 1, further comprising a brake assembly;

wherein the brake assembly comprises a hand brake, a brake pad housing, a brake pad, and a brake cable.

13. The combination wheelchair-walker device of claim 1, further comprising two push rails, each of which is spaced apart from and outwardly of one of the two front wheels;

wherein each of the two front wheels comprises a front wheel frame; and wherein the push rail is connected to the front wheel frame of one of the two front wheels.

* * * * *